US007497564B2

(12) United States Patent
Yui

(10) Patent No.: US 7,497,564 B2
(45) Date of Patent: Mar. 3, 2009

(54) LIQUID ABSORBING MEMBER AND INK JET RECORDING APPARATUS

(75) Inventor: Toshitake Yui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 360 days.

(21) Appl. No.: 11/053,795

(22) Filed: Feb. 9, 2005

(65) Prior Publication Data

US 2006/0055755 A1 Mar. 16, 2006

(30) Foreign Application Priority Data

Sep. 16, 2004 (JP) ..... 2004-270164

(51) Int. Cl.
*B41J 2/195* (2006.01)

(52) U.S. Cl. ..... 347/101; 264/122; 264/518; 264/640; 347/33; 347/35; 347/36; 347/103; 347/105; 399/249; 399/250; 399/327; 428/352; 428/392; 428/402

(58) Field of Classification Search ..... 101/424, 101/1; 264/122, 518, 640; 347/31, 33, 35, 347/36, 86, 96, 101, 103, 105, 115; 399/249, 399/250, 327; 428/32.25, 68, 71, 126; 442/352, 442/392, 402

See application file for complete search history.

(56) References Cited

U.S. PATENT DOCUMENTS

| | | | | |
|---|---|---|---|---|
| 5,552,817 | A * | 9/1996 | Kuehnle | 347/115 |
| 5,649,130 | A * | 7/1997 | Nakajima et al. | 399/327 |
| 5,841,456 | A * | 11/1998 | Takei et al. | 347/103 |
| 6,006,059 | A * | 12/1999 | Till et al. | 399/249 |
| 6,084,620 | A * | 7/2000 | Morikawa et al. | 347/96 |
| 6,228,475 | B1 * | 5/2001 | Chu et al. | 428/32.25 |
| 6,356,728 | B1 * | 3/2002 | Watanabe | 399/250 |
| 6,809,047 | B2 * | 10/2004 | Lebold et al. | 442/392 |
| 7,121,203 | B2 * | 10/2006 | Pickering et al. | 101/424.1 |
| 2002/0031968 | A1 * | 3/2002 | Hamaguchi et al. | 442/402 |
| 2002/0171719 | A1 | 11/2002 | Shimizu et al. | |
| 2003/0160850 | A1 * | 8/2003 | Ohya et al. | 347/101 |
| 2005/0212884 | A1 * | 9/2005 | Ueki et al. | 347/105 |
| 2006/0061642 | A1 * | 3/2006 | Ueki | 347/101 |

FOREIGN PATENT DOCUMENTS

| | | | |
|---|---|---|---|
| JP | 05096720 | A * | 4/1993 |
| JP | 2000-6494 | | 1/2000 |
| JP | 2001-179959 | | 7/2003 |

OTHER PUBLICATIONS

Machine Translation of JP 2001-179959http://dossier1.ipdl.inpit.go.jp/AIPN/aipn_call_transl.ipdl?N0000=7413&N0120=01&N2001=2&N3001=2001-179959&Ntt1=electronics_v5&Ntt2=chemistry_v5&Ntt3=machine_v5&Ntt4=&Ntt5=&Ntt6=&Ntt7=&Ntt8=&Ntt9=&Ntt10=.*

* cited by examiner

*Primary Examiner*—Luu Matthew
*Assistant Examiner*—John P Zimmermann
(74) *Attorney, Agent, or Firm*—Fildes & Outland, P.C.

(57) ABSTRACT

The present invention provides a liquid absorbing member for absorbing excessive ink components from an ink image formed on a recording medium by an ink jet recording method, in which the liquid absorbing member contains fibrous matter, and the fiber thickness of fibers composing the fibrous matter is in a range of about 0.01 to 100 dtex. The fibrous matter preferably contains fibers having a fiber diameter in a range of about 0.5 to 10 μm, and fibers composing the fibrous matter are preferably polyester fibers. The invention also provides an ink jet recording apparatus comprising a printhead and the liquid absorbing member.

16 Claims, 3 Drawing Sheets

LIQUID ABSORBING MEMBER AND INK JET RECORDING APPARATUS

CROSS-REFERENCE TO RELATED APPLICATION

This application claims priority under 35USC 119 from Japanese Patent Application No. 2004-270164, the disclosure of which is incorporated by reference.

BACKGROUND OF THE INVENTION

1. Field of the Invention

The present invention relates to an ink jet recording apparatus for forming an ink image by ejecting ink from a printhead, and a liquid absorbing member for removing ink components from the ink image.

2. Description of the Related Art

Color documents are in wide use in offices recently, and various output devices have been proposed. In particular, the ink jet method, that is miniaturizable and inexpensive, is used in various output devices.

A printhead used in the ink jet method comprises as energy generating portion, an energy converting portion for converting the energy generated by the energy generating portion into an ink ejecting force, an ink ejecting port for which ink drops are ejected by the ink ejecting force, and an ink feeding route communicating with the ink ejecting port for supplying ink drops. Examples of the energy generating portion include a portion using electromechanical converting elements such as a piezoelectric element, and a portion which heats an ink by an electro-thermal converting element having a heat generating resistance element to generate foams, and ejecting ink drops by this generation of foams.

In such ink jet methods, ink is mainly composed of liquid components. Therefore, when ink drops remain on the recording medium after being ejected onto a recording medium, they may be transferred to another recording medium. This phenomenon is more obvious in high speed printing. Further, when the system that uses another treating liquid in addition to ink (namely, a two-pack system) is used in order to achieve higher image quality, the volume of the liquid increases. Thus, as compared with when the treating liquid is not used, a larger amount of liquid is absorbed by the recording medium, and accordingly curling and/or cockling are more likely to occur. When printing on the reverse side is conducted, head rubbing occurs, which causes image quality deterioration.

In particular, when ink jet recording is intended to be applied to the printing field, it is required to be able to be used for printing on an impermeable recording medium such as art paper, which is a coated paper, or resin film. Since such impermeable recording media basically hardly absorb liquid components of ink therein, the problem of image quality deterioration from unfixed colorant in the printed ink image becomes apparent.

Hence, various methods have been proposed to heat or send air in order to quickly dry printed media after the media have received ejected ink. In these methods, however, energy consumption increases, and a large apparatus is needed. On the other hand, there is a method in which an excessive ink liquid remaining on a recording medium is absorbed by paper, however, colorant components in the ink image may be absorbed at the same time, and therefore is not practicable.

In particular, when printing is conducted by using the above-described impermeable recording media, an additional step of removing liquid components other than colorant components in the ink image after printing is required. Further, in order to assure image quality, a proper method is desired so as not to deteriorate the image or press and damage the image.

In order to absorb only liquid components (liquid solvent) of ink, it has been proposed that only excessive liquid (liquid solvent) of ink remaining on the recording medium be absorbed by using a liquid absorber covered with a member having the property of releasing from a coloring agent (colorant) after printing (after ink is ejected on a recording medium) (see, for example, Japanese Patent Application Laid-Open No. 2001-179959).

In this proposal, however, since the liquid absorber is made of a material having the property of eleasing from the coloring agent disposed on a contact side (surface) with the liquid solvent, it also parts from the liquid solvent, and thus cannot sufficiently absorb the liquid solvent. Moreover, since a hydrophobic portion is present on the surface, the ink is rejected, which causes deterioration in image quality.

When liquid volume is increased by using a treating liquid in addition to ink or when high speed printing is conducted, it is desired that ink components be absorbed quickly, however, the above-described method is not sufficient.

Moreover, since this method is designed to absorb ink by pressing a roller having a liquid absorber, the image may be pressed and spreading may occur, and an image of high quality may be spoiled in particular when an impermeable recording medium is used.

SUMMARY OF THE INVENTION

The present invention is provided accounting for the problems as described above.

Namely, the invention provides a liquid absorbing member capable of surely absorbing only the liquid component in an unfixed ink image, even in the case of using a recording medium which hardly absorbs ink, and capable of obtaining an image of high quality without causing image quality deterioration, pressing, or crushing of an image. Further, the invention provides an ink jet recording apparatus including the same.

That is, the invention provides a liquid absorbing member for absorbing excessive ink components from an ink image formed on a recording medium during ink jet recording, wherein the liquid absorbing member contains fibrous matter, and the fiber thickness of fibers composing the fibrous matter is in a range of about 0.01 to 100 dtex.

Further, the invention provides an ink jet recording apparatus comprising: a printhead for forming an ink image by ejecting a printing liquid containing ink onto a recording medium, and liquid absorbing portion for absorbing excessive ink components from the ink image.

BRIEF DESCRIPTION OF THE DRAWINGS

Preferable embodiments of the present invention will be described in detail based on the following figures, wherein.

DETAILED DESCRIPTION OF THE INVENTION

Liquid Absorbing Member

Figure 1:
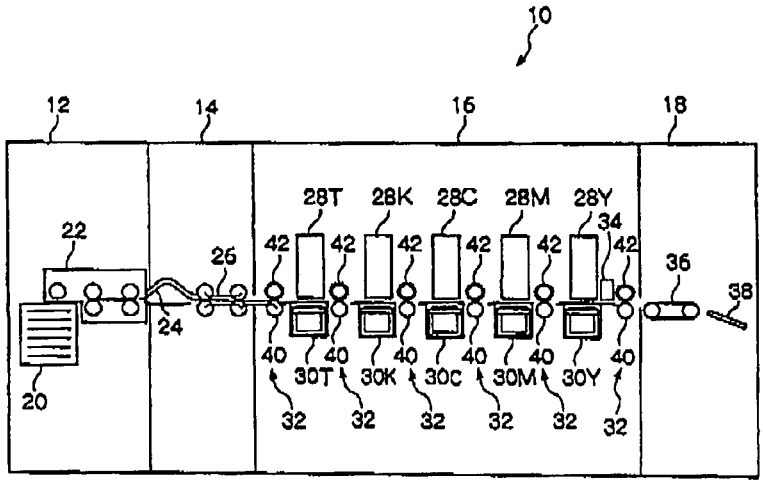
FIG. 1 is a block diagram of an example of ink jet recording apparatus of the invention.

The liquid absorbing member of the invention is a liquid absorbing member for absorbing excessive ink components from an ink image formed on a recording medium by an ink jet recording method. The liquid absorbing member contains fibrous matter, and the fiber thickness of fibers composing the fibrous matter is in a range of about 0.01 to 100 dtex.

In formation of an ink image on a recording medium by an ink jet recording method, in particular, when using a recording medium that hardly absorbs liquid components of ink such as the above-described art paper, ink drops ejected from a printhead mostly remain on the recording medium. In this case, therefore, the problem is of poor image quality due to unfixing of an image, rather than of transfer to another recording medium.

In order to fix an ink image on the recording medium promptly, basically, the only method was for another liquid absorbing member to be brought into contact with the unfixed ink image, and only liquid components (excessive ink components) were instantly absorbed from the ink image. When using a conventional liquid absorbing member, however, liquid absorption was slow, colorants in the ink components were also absorbed, or the image was damaged due to friction during absorption.

In the invention, the ink components refer to liquid components in an unfixed ink image, or liquid components and other components such as colorants, but excessive ink components are preferred to be liquid components alone. In the case of the two-pack system, the ink image includes the component of treating liquid besides ink.

As a result of investigations by the present inventors, it has been found that the problem cannot be solved by an ordinary liquid absorbing member made of high polymer absorber, and that the cause lies in the polymer fiber diameter of about 15 μm or more that composes the fibrous matter. That is, to absorb the liquid by using a fibrous matter, not only the liquid affinity of fibers, but also the capillary action arising from space between fibers is important, and when the fibrous matter is composed of fibers of fiber diameter of about 15 μm or more, the space between fibers is too wide, and the fibrous matter must be pressed tightly to an object when the fibrous matter is absorbing the liquid. It has also been found that fine particles dispersed in the liquid are absorbed at the same time.

Accordingly, if an attempt were made to absorb only the liquid components from an ink image after the ink is ejected on the recording medium, the fibrous matter also absorbs the colorant in the ink image, and moreover, the fibrous matter is pressed hard to the ink image, and the image may be destroyed. This phenomenon is particularly obvious when the liquid volume is large in an unfixed ink image, for example, in the case of using art paper or the like as the recording medium, or when using treating liquid other than ink when forming an ink image.

The inventors have investigated further, in order to solve the problems, the liquid absorbing property and image holding property of ink images by using fibrous matter made of fibers with a smaller fiber diameter, and discovered that the problem can be solved by using a fibrous matter made of fibers having a fiber thickness in a range of about 0.01 to 100 dtex, and have thereby arrived at the invention.

Herein, the fibrous matter refers to a collected body (aggregate) of fibers, including a mere collected lump of fibers, a high density array of fibers, and a mutually partially bonded assembly of fibers.

In the invention, the fiber thickness is preferred to be in a range of about 0.01 to 80 dtex, or more preferably about 0.01 to 60 dtex. It is practically difficult to obtain a fiber of which fiber thickness is about less than 0.01 dtex, as sufficient fiber strength cannot be maintained. If the fiber thickness exceeds about 100 dtex, problems with general high polymer absorbers cannot be avoided.

The fibrous matter of the invention is desired to contain fibers having a fiber diameter in a range of about 0.5 to 10 μm, more preferably about 0.6 to 8 μm. The fiber thickness expresses the mean diameter of fibers, and the fiber diameter represents the diameter substantially, and by using the fibers of fiber diameter in this specified range, problems with general high polymer absorbers can be avoided.

To exhibit the desired properties, the fibrous matter is preferred to contain fibers having a fiber diameter in a range of about 0.5 to 10 μm, by about 20 to 100 mass % relative to the total amount of the fibrous matter.

Fibers for composing the fibrous matter of the invention include, for example, synthetic fibers such as nylon fiber, polyester fiber, polypropylene fiber, polyvinyl chloride fiber, polyamide fiber, and polyurethane fiber; natural fibers such as wood pulp, cotton, and wool; semisynthetic fibers such as viscose rayon, acetate, and cupra; and inorganic fibers such as carbon fiber, titanium fiber, and glass fiber. Most preferably, polyester fiber is selected from the viewpoint of cost and length of life.

The liquid absorbing member of the invention contains such fibrous matter, the form of which includes a knit of twisted yarns of fiber, a net, a woven fabric, a nonwoven fabric of partly fused or mutually entangled fibers, a web, and a sheet.

The liquid absorbing member of the invention may either contain such fibrous matter only, or may also contain adhesive or a binder in addition to the fibrous matter, or further a fibrous matter may be fixed on a base material.

Thus, in absorption of liquid components using the fibrous matter of the invention, as described above, the capillary action plays a vital role. Therefore, the density of the fibrous matter as a collected body of fibers is also important. In the invention, the fiber weight per square centimeter is preferred to be in a range of about 20 to 3,000 g/cm$^2$, more preferably about 25 to 2,500 g/cm$^2$. If the fiber weight is less than about 20 g/cm$^2$ gaps between fibers are too wide, and only the liquid components of ink cannot be absorbed efficiently, or soft absorption (absorption without pressing hard to the ink image) is not realized. If the fiber weight exceeds about 3000 g/cm2, capillary action may not take place with ink components.

The water absorption of the fibrous matter of the invention thus composed, as measured by a known testing method for woven fabrics (water dripping method) for measuring the wetting time by dripping a drop (50 μL) of water, is preferred to be about 1 second or less, and more preferably about 0.5 second or less. If the water absorption is more than about 1 second, fixing of an image after printing is not sufficient, and it may not be used as a liquid absorbing portion of an ink jet recording apparatus described below.

Ink Jet Recording Apparatus

An ink jet recording apparatus of the invention is now described.

The ink jet recording apparatus of the invention is an ink jet recording apparatus comprising at least a printhead for forming an ink image by ejecting a printing liquid including ink on a recording medium, and a liquid absorbing portion for absorbing excessive ink components from the ink image, in which a liquid absorbing member used in the liquid absorbing portion contains a fibrous matter, and the fiber thickness of fibers composing the fibrous matter is in a range of about 0.01 to 100 dtex.

The apparatus is specifically described below with reference to the drawings. Members having substantially similar functions are identified with the same reference numerals throughout the drawings. In all drawings, P refers to paper (recording medium).

FIG. 1 is a block diagram of an example of an ink jet recording apparatus of the invention.

An ink jet recording apparatus 10 basically comprises, as shown in FIG. 1, a paper feed section 12 for sending out paper, a registering section 14 controlling the position of paper, a recording section 16 for forming an image on paper (recording medium) by using printing liquid (ink, treating liquid), and a paper discharge section 18 for discharging the paper after forming of an image by the recording section 16.

The paper feed section 12 includes a stocker 20 for stocking a pile of sheets of paper, and a conveying device 22 for picking up each sheet from the stocker 20 and conveying each sheet to the registering section 14. The paper used is art paper.

The art paper is a coated paper made of high-quality paper of a coating weight of 40 g/m$^2$ or more, and the paper has poor absorption of ink for ink jet recording. In the invention, the paper usable is not particularly limited, but the art paper or resin film having poor absorption of ink can be also used.

The registering section 14 includes a loop forming section 24 and a guide member 26 for controlling the position of the paper. When the paper passes through this section, skew is corrected by making use of the consistency of the paper, conveying timing is controlled, and the paper is fed into the recording section 16.

The recording unit 16 includes basically printheads 28 for forming an ink image by ejecting a printing liquid (ink, treating liquid) onto paper (recording medium), maintenance devices 30 disposed opposite to the nozzle side of the printheads 28, and conveying portion 32 for conveying paper between the printheads 28 and the maintenance devices 30. The printheads 28 are capable of printing in full color by printing in the sequence of treating liquid (T), black (K), cyan (C), magenta (M), and yellow (Y) sequentially from the upstream side in the conveying direction (the sequence will be also from the ink to the treating liquid, but the sequence from the treating liquid to the ink is more preferable). When necessary, the individual printheads may be distinguished by identifying with the symbols T, K, C, M and Y (28T, 28K, 28C, 28M and 28Y). Other members will be similarly distinguished (maintenance devices 30T to 30Y).

Near the exit of the recording section 16, a liquid absorbing device (liquid absorbing portion) 34 is disposed, that is, at the downstream side of the printheads 28Y, for absorbing excessive ink components of the printing liquid (ink, treating liquid) ejected on the paper from the printheads 28T to 28Y. By this liquid absorbing device 34, excessive ink components are absorbed from the ink image on the paper after the ink (including treating liquid) sequentially hits the paper by the printheads 28T to 28Y.

The printheads 28 and the maintenance devices 30 are formed as individual units, and the printheads 28 can be separated by the paper conveying route from the maintenance devices 30. Therefore, in the case of paper jamming, the jammed paper can be removed easily.

The paper discharge section 18 discharges the paper having had an image formed thereon by the recording section 16 for storage in a tray 38 by way of a paper discharge belt 36.

The printing liquid is a two-pack ink set containing at least an ink including pigment (colorant), water-soluble solvent and water, and a treating liquid having an action of aggregating the pigment of the ink. In the embodiment, as described above, the printhead 28T ejects the treating liquid, and the printheads 28K to 28Y eject full color black, cyan, magenta, and yellow inks individually. Description will now be given in detail.

The liquid absorbing device 34 is described below.

The liquid absorbing device 34 is employable in various methods, such as roller method, belt method, or take-up paper method. By employing these methods, excessive ink components in ink images can be efficiently absorbed with a simple structure.

Figure 2:
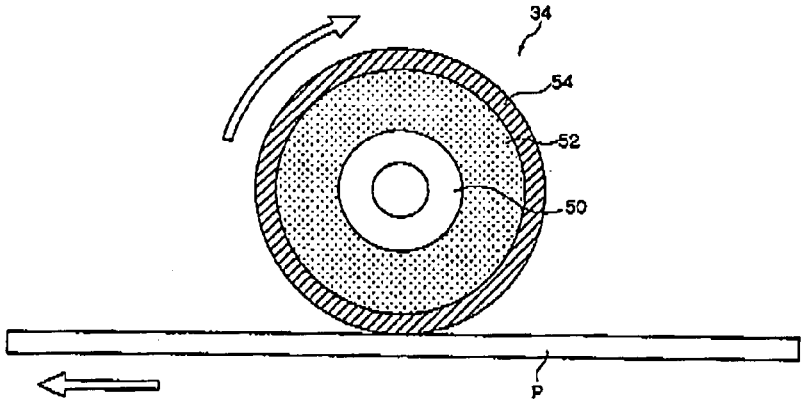
FIG. 2 is a schematic view of an example of a liquid absorbing device (liquid absorbing portion) using a liquid absorbing member of the invention.

A specific structure is explained. The liquid absorbing device 34 is composed, for example, as shown in FIG. 2, which shows a roller-form liquid absorbing device 34 composed of a liquid absorbing roller (liquid absorbing portion) having an absorber layer 52 and a hydrophilic absorbing layer 54 sequentially coated on the outer circumference of a metal shaft 50.

For the hydrophilic absorbing layer 54, the liquid absorbing member of the invention is used, and more specifically a sheet of fibrous matter having aggregated water absorbing fibers of a fiber thickness of 10 dtex at a fiber density of about 50 g/cm$^2$ is fixed on the absorber layer 52 in a thickness of about 20 mm. This fibrous matter contains fibers of a fiber diameter of about 5 μm in about 50 to 70 mass %.

Figure 3:
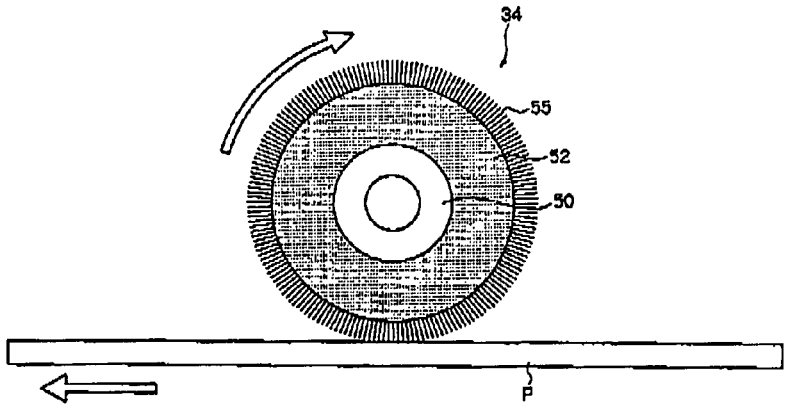
FIG. 3 is a schematic view of an example of a liquid absorbing device (liquid absorbing portion) using a liquid absorbing member of the invention.

The hydrophilic water absorbing layer of the liquid absorbing roller of the invention may be, as shown in FIG. 3, a hydrophilic water absorbing layer 55 of thread-like fibrous matter planted in the surface of the absorber layer 52, using fibers of the same fiber thickness and composed in the same fiber density.

The hydrophilic absorbing layer 54 contacts with an ink image after aggregating of pigment using a two-pack ink set. Excessive ink components in an ink image are absorbed by the absorber layer 52 by way of the hydrophilic absorbing layer 54. The hydrophilic absorbing layer 54 does not allow the aggregate of pigment to pass through it, and substantially only the excessive ink components can pass through it (liquid components). Herein, the aggregate is formed of the ink in the ink set described below, and the treating liquid having an aggregating action on the ink.

More specifically, when the hydrophilic absorbing layer 54 filters alone fine particles of volume-average particle size of 5 μm, its recovery rate is preferred to be about 90% or more. That is, since the recovery rate of fine particles of a volume-average particle size of 5 μm is about 90% or more, the hydrophilic absorbing layer 54 allows only the excessive ink components substantially pass, without allowing the aggregate of the pigment to pass.

The recovery rate is determined as follows. That is, the number of particles of a particle size of 5 μm or more is counted before and after filtering by using an optical particles sizer (trade name: ACCUSIZER TM770, manufactured by Particle Sizing System CO., LTD.). In measurement, 2 μL of water-based ink jet recording liquid is put in a measuring cell, measured according to a specified method, and converted into desired units. The recovery rate R is determined using the following Formula (1).

Formula (1):

$R$ (%)=[(number of particles larger than 5 μm measured before filtering−number of particles larger than 5 μm measured after filtering)/(number of particles larger than 5 μm measured before filtering)]×100

In the case of contact of the hydrophilic absorbing layer 54 with the ink image, so as not to disturb the ink image, the pressure of the liquid absorbing roller and the paper should be preferably controlled to be in a range of about 0.01 to 1 MPa, and the circumferential speed of the liquid absorbing roller is preferred to be the same as the conveying speed of the paper. Furthermore, the timing of contact of an ink image with the hydrophilic absorbing layer 54 is preferred to be in a range of about 0.05 to 100 msec after printing by the final printhead 28Y.

The absorber layer 52 absorbs excessive ink components contacting with the hydrophilic absorbing layer 54 by way of the hydrophilic absorbing layer 54, and from the viewpoint of efficient absorption of excessive ink components, a porous material or fibrous material is preferred. Specific examples of constituent material include wool, cotton, silk, polyester, polyamide, polyacrylonitrile, polypropylene, cellulose, urethane, melamine, other natural fibers, chemical fibers, and porous materials. An organic or inorganic filler may be added to these materials in order to control the strength or surface state.

The absorber layer 52 is preferably formed to become gradually higher in fiber density or pore density from outside to inside. As a result, excessive ink components absorbed by way of the hydrophilic absorbing layer 54 can be moved to inside (toward the metal shaft 50) by capillary action.

Figure 4:
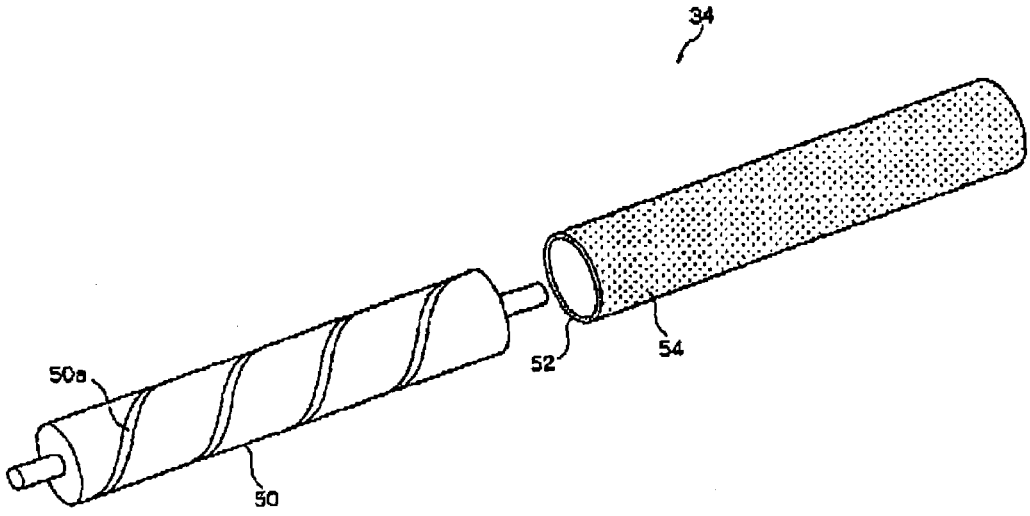
FIG. 4 is an oblique perspective view of an example of a liquid absorbing device (liquid absorbing portion) using a liquid absorbing member of the invention.

The metal shaft 50 is composed of metal material such as stainless steel or aluminum. Spiral grooves 50*a* are formed on the outer circumference of the metal shaft 50 as shown in FIG. 4.

In the roller-form liquid absorbing device of the embodiment, while rotating the liquid absorbing roller, the hydrophilic absorbing layer 54 is brought into contact with the excessive ink components of the printing liquid remaining on the paper, and the excessive ink components are absorbed by the absorber layer 52 by way of the hydrophilic absorbing layer 54. Consequently, the excessive ink components absorbed on the hydrophilic absorber layer 52 reach the grooves 50*a* of the metal shaft 50, and by rotating the metal shaft 50, the excessive ink components pass along the grooves 50*a*, move to one end, and are collected in a recovery container (not shown). Thus, the excessive ink components of the ink image on the paper (recording medium) are absorbed.

In the invention, aside from the purpose of collecting the ink components absorbed from the ink image, another portion may be provided for drying the ink components absorbed in the fibrous matter of the hydrophilic water absorbing layer. Such portion may be designed to blow hot air to the hydrophilic water absorbing layer when an image is not being formed, for example, in the liquid absorbing roller, or to warm the entire roller by heating the metal shaft.

Figure 5:
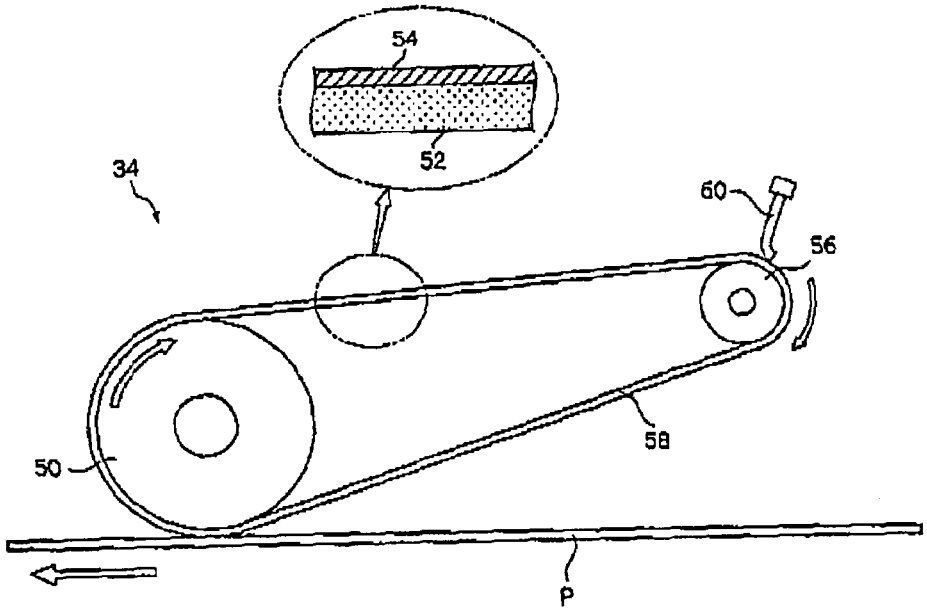
FIG. 5 is a schematic view of an example of a liquid absorbing device (liquid absorbing portion) using a liquid absorbing member of the invention.

Another form of the liquid absorbing device 34 is shown in FIG. 5, which shows an endless belt type liquid absorbing device 34 comprising a metal shaft 50, a stretching shaft 56, a liquid absorbing endless belt (liquid absorbing portion) 58 stretched between the two shafts, and a blade 60 for cleaning the surface of the liquid absorbing endless belt.

The liquid absorbing endless belt 58 has a layered structure consisting of an absorber layer 52 and a hydrophilic absorbing layer 54 laminated from the inner circumferential side, and this structure may be similar to that of the roller method. The outer circumference of the metal shaft 50 is provided with spiral grooves, which are similar to the spiral grooves 50*a* shown in FIG. 4. Although not shown in the drawing, similar spiral grooves are provided on the outer circumference of the stretching shaft 56.

In the endless belt type liquid absorbing device 34, the endless belt 58 is rotated along with rotation of the metal shaft 50 or the stretching shaft 56, and excessive ink components of an ink image on the paper (recording medium) are absorbed in the same manner as those in the roller-form liquid absorbing device 34.

Figure 6:
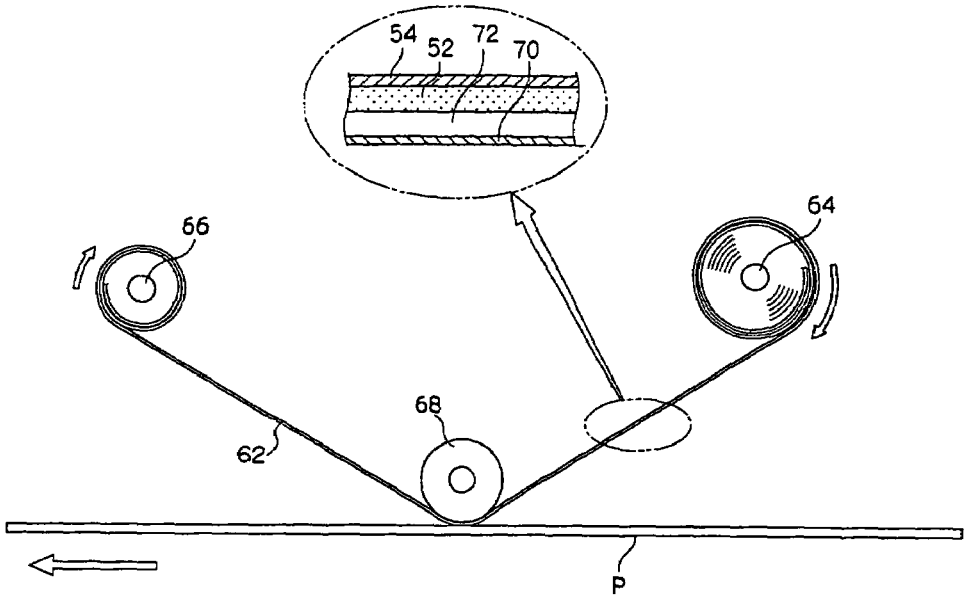
FIG. 6 is a schematic view of an example of a liquid absorbing device (liquid absorbing portion) using a liquid absorbing member of the invention.

Further, a different form of the liquid absorbing device 34 is shown in FIG. 6, which shows a liquid absorbing device of take-up paper system comprising a take-up paper 62 for absorbing liquid (liquid absorbing portion), a roller 64 on which the take-up paper 62 is wound, a take-up roller 66 for taking up the take-up paper 62 wound on the roller 64 from one end, and a pressing roller 68 for pressing the take-up paper to the paper from the take-up surface side.

The liquid absorbing take-up paper 62 has a layered structure consisting of a liquid permeation preventive layer 70, a liquid holding layer 72, an absorber layer 52, and a hydrophilic absorbing layer 54 laminated from the take-up surface side of the roller 64. The hydrophilic absorbing layer 54 and the absorber layer 52 can be similar to those of the roller method. In the roller method, however, spiral grooves 50*a* are provided in the metal shaft 50 to realize the excessive liquid collecting mechanism, but they are not provided in this example, and thus in order to enhance the liquid holding capacity, the liquid holding layer 72 is provided, supported by the liquid permeation preventive layer 70 and the liquid absorber layer 52.

A preferred example of the material for composing the liquid holding layer 72 is hydrophilic polymer powder. This water-soluble polymer includes starch, cellulose, and synthetic polymers, and specific examples include crosslinked polyacrylate system, isobutylene/maleate system, starch/polyacrylate system, and PVA (polyvinyl alcohol)/polyacrylate system.

The material for composing the liquid permeation preventive layer 70 is not particularly limited, as long as the excessive ink components held in the liquid holding layer 72 are prevented from leaking to the roller take-up surface side. Preferred examples include polyethylene, polyethylene terephthalate, polypropylene, polyvinyl chloride, and polyvinilidene fluoride.

In the take-up paper type liquid absorbing device, while the take-up roller 66 takes up the liquid absorbing take-up paper 62, the pressing roller 68 presses the surface of the hydrophilic absorbing layer 54 to an ink image on the paper, and the excessive ink components are absorbed by the absorber layer 52 by way of the hydrophilic absorbing layer 54. The excessive ink components absorbed by the liquid absorber layer 52 reach the liquid holding layer 72, and the excessive ink components are collected and held by the liquid holding layer 72. Further, the excessive ink components can be also absorbed while taking up the take-up roller 66 and the wound take-up paper 62 again on the roller 64.

In any of the structures, the liquid absorbing device 34 is preferred to comprise an absorbing area corresponding to the maximum width of the paper, in the same manner as the printheads 28 described below. Furthermore, the layers do not necessarily need to be composed of different members, but may be integrally composed of the same material.

Next, the constituent members of the recording section 16, that is, the printhead 28, paper P and maintenance devices 30 are sequentially described below.

The printhead 28 may be any one of printheads used for such as thermal ink jet printing, piezo ink jet printing, continuous flow ink jet printing, and electrostatic absorption type ink jet printing, as long as the printheads transfer printing liquid directly onto a paper without making contact with the paper.

Figure 7:
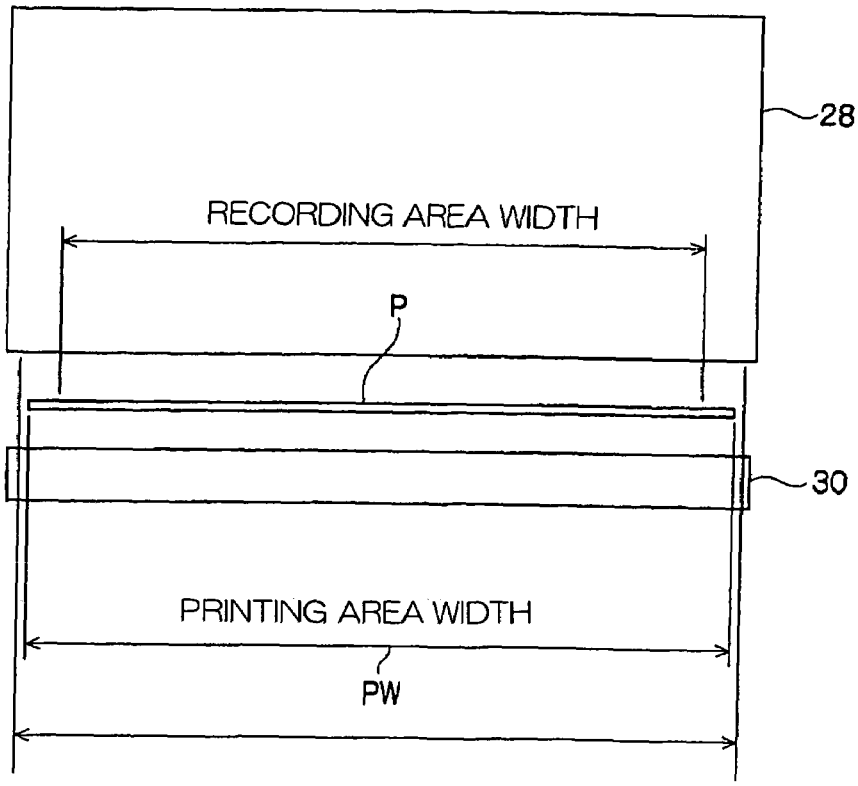
FIG. 7 is a schematic view of a printhead section of an ink jet recording apparatus of the invention.

FIG. 7 shows the configuration of one of each of the printhead 28, a paper sheet P, and the maintenance devices 30 as seen from the paper conveying direction, in which the printhead 28 is preferred to have a printing area corresponding to the maximum width PW of the paper. In this form, therefore, it is possible to print in the overall width of the paper without scanning the printhead 28. That is, printing is completed by the paper passing beneath the printhead 28 only once.

When a printing margin is set in the paper, the printing area of the printhead 28 is a width corresponding to a recording area (and wider than the recording area) equal to the maximum paper width PW minus the printing margin.

Generally, the paper may be conveyed at an inclination of a specific angle with respect to the conveying direction (known as skew), or no-margin printing may be also required, and hence the printing area of the printhead 28 is preferred to be larger than the recording area.

The printhead 28 may be composed of monolithic long heads (head tips) having nozzles formed in one row in the printing area, but it may be preferred to compose the printhead 28 by combining short heads (head tips, hereinafter, also referred to as unit printheads). Unit printheads can be mass-produced, and it is much easier to enhance the yield of individual short heads as compared with monolithic long heads. Hence the cost is lower when the printhead 28 is composed by combining unit printheads.

For example, unit printheads having nozzles arrayed in one row on the nozzle surface are mounted on two common substrates by matching the nozzle rows, and are disposed in a deviated manner from each other, such that a printhead 28 capable of printing without interruption within the printing area can be realized. In this case, mass-produced inexpensive devices (printheads) can be commonly used, and an inexpensive and full-width printing printhead 28 can be composed.

As unit printheads, commercial or known serial recording type ink jet printheads may be used. Or, unit printheads can be composed of head tips only, and the printing liquid may be supplied to the plural head tips through a printing liquid passage (ink passage) provided on a common substrate. More preferably, each unit printhead may be designed to be exchangable.

The printhead 28 may be also composed by disposing unit printheads, having nozzles formed in the unit printheads to as far as the end in the nozzle array direction, continuously in the width direction. Although the end portion of the unit printhead must be manufactured with high precision to match the nozzle pitch at the junction of the unit printheads, the printheads 28 can be formed in a smallest size.

The nozzle array of the unit printheads may be formed in a straight line, but is not limited to this example. For example, the nozzles can be disposed in zigzag form.

The maintenance device 30 disposed opposite to the printheads 28 has a printing liquid receiving unit for receiving printing liquid (ink, treating liquid) ejected from the printhead 28 during at least while not printing, and it is intended to maintain a constant printing performance (ejection of printing liquid) of the printheads 28. Since the maintenance device 30 having the printing liquid receiving unit is disposed opposite to the printhead 28, the printing liquid transferred from the printheads 28 while not printing is ensured of being collected.

The printhead 28 is required to eject the printing liquid while not printing (hereinafter called dummy jetting) in order to initialize the ejection performance of printing liquid due to printing liquid having dried (in particular, waterbased ink, solvent ink).

Even in the case of oil-based ink or solid ink, in which there is hardly any drying of the printing liquid (ink), dummy jetting is required for initializing by removing the effects of small bubbles generated in the printhead 28 while printing, or the effects of printing liquid or small dust particles sticking to the nozzle surface (printing liquid ejecting surface).

The maintenance device 30 (printing liquid receiving unit) collects the printing liquid during this dummy jetting, and a printing liquid absorbing member may be disposed such that the collected printing liquid does not scatter. Or, it may be designed to discharge the liquid into a liquid discharge portion disposed elsewhere by way of a printing liquid permeation member or a tube member.

The maintenance device 30 is required to have at least the printing liquid receiving function, and to maintain the ejection performance of the printing liquid, another maintenance function may be provided. For example, a wiper member may be provided for cleaning the nozzle surface, or a capping function may be provided for protecting the nozzle surface by keeping it airtight. It is further desired to have a vacuum function for sucking printing ink from the nozzles.

In addition to the printing liquid receiving function, the maintenance device 30 is not always required to have other functions such as the mentioned wiping function or capping function. Such functions (wiping function and capping function) may be provided, for example, on the printhead side.

The conveying portion 32 is designed to convey the paper by method other than electrostatic adsorption (hereinafter called non-electrostatic adsorption method). That is, the conveying portion 32 is not particularly limited as long as the paper can be conveyed stably at a constant speed between the printheads 28 and the maintenance device 30. For example, it may be realized by a combination of a conveying roller, conveying belt, and pressing portion.

It is desirable that the conveying portion 32 be disposed at a position different from the printheads 28 in the paper conveying direction. This is for ease of disposing the maintenance device 30 at a position opposite to the printheads 28.

For example, the conveying portion 32 is considered as being composed of a conveying roller 40 for applying a driving force to the paper by pressing against the reverse side of the paper, and a thrusting portion (not shown in the figure) for pressing the paper to the conveying roller 40.

This is since the electrostatic adsorption state may not be stable depending on the paper thickness or paper quality in the electrostatic adsorption method. However, by pressing the paper to the conveying roller 40 with the thrusting portion, the driving force is ensured of being transmitted from the conveying roller 40 to the paper regardless of the paper thickness or material, and the paper can be conveyed stably.

The thrusting portion may include a method involving thrusting the thrusting portion by contacting directly with the paper, or a method involving not contacting directly with the paper. As the latter method, for example, an air blowing method may be considered. This method it is excellent in that it is free from contact with the printed paper.

On the other hand, in the embodiment, the former method employs a star wheel 42 receiving the thrusting force of a spring through a shaft (not shown). That is, the paper is pressed to the conveying roller 40, regardless of the thickness or material, by the star wheel 42 elastically forced against the conveying roller 40. As a result, the driving force is securely transmitted from the conveying roller 40, and the paper is conveyed stably.

The shape of the star wheel 42 is not particularly limited as long as the contact area on the paper is kept minimal. The material of the star wheel 42 may be metal or plastic. A preferred example is a material prepared by hardening SUS631H (commonly-known stainless steel material that consists of the main component Fe and additive chemical components of 16 to 18% by mass of Cr, 6.5 to 7.75% by mass of Ni, 1% by mass or less of Mn, and 0.75 to 1.5% by mass of Al) at a high temperature. The manufacturing method is not particularly limited, and includes etching, pressing, and laser processing.

Therefore, if the star wheel 42 contacts with the recording surface of the paper, the contact area on the recording surface right after transfer of printing liquid is kept to a minimum, and effects on printing quality may be kept to a minimum.

The pressing force acting on the star wheel 42 through the shaft is preferably about 49.03325 mN to 294.1995 mN (about 5 gf to 30 gf), more preferably about 98.0665 mN to 196.133 mN (about 10 gf to 20 gf). If smaller than about 49.03325 mN (about 5 gf), the paper cannot be suppressed sufficiently, or if larger than about 294.1995 mN (about 30 gf), the paper may be damaged.

When composing a star wheel group by using plural star wheels 42, they are preferably supported on a common shaft, and the space between the star wheels 42 should be preferably about 50 mm or less in order to suppress local lifting or deformation of the paper.

If the printing area is large, preferably, the shaft should be divided into plural sections, and the plural star wheels 42 should be supported individually. Otherwise, the shaft may undergo flexion, and the paper be forced unevenly by the star wheels 42, leaving an inability to suppress local lifting or deformation of the paper.

The conveying roller 40 may be realized with any known conveying roller. To ensure transmission of the driving force to the paper, it is preferred that a roller having a large surface friction coefficient and excellent wear resistance be used. Preferred examples include a rubber roller where the outer circumference of a metal roller is coated with rubber, and a ceramic roller where the outer circumference of a metal roller is coated with ceramic powder.

Next, the printing liquid (ink, treating liquid) of the invention is explained.

The printing liquid should comprise an ink containing at least pigment (colorant), water-soluble solvent, and water, and a treating liquid having an aggregating and/or thickening action on the ink. In the embodiment, the treating liquid is used separately from the ink, but a pigment may be contained for use as an ink (for example, yellow ink).

The ink includes at least the pigment, water-soluble solvent, and water. The particle size of the pigment is preferred to be about 10 to 200 nm before aggregation of the pigment, and the size of aggregate formed througroughly aggregation by the treating liquid is preferred to be about 0.5 μm or more. Hence, a high image quality and density is obtained, and the pigment has difficulty in being absorbed by the liquid absorbing device, such that excessive liquid of the ink can be absorbed effectively.

The pigment may use any of an organic pigment and an inorganic pigment, and black pigments include carbon black pigments such as furnace black, lamp black, acetylene black and channel black. In addition to the black pigments and three primary colors of cyan, magenta, and yellow, other pigments such as specific color pigments of red, green, blue, brown, white, and the like, metal gloss pigments of gold color, silver color, and the like, and extender pigments of colorless or pale color, plastic pigments, and the like may also be used. A pigment that is newly synthesized for the invention may also be used.

Specific examples of black pigments include, but are not limited to, RAVEN 7000, RAVEN 5750, RAVEN 5250, RAVEN 5000, ULTRA II, RAVEN 3500, RAVEN 2000, RAVEN 1500, RAVEN 1250, RAVEN 1200, RAVEN 1190, RAVEN 1170, RAVEN 1255, RAVEN 1080, and RAVEN 1060 (trade names, manufactured by Columbian Chemicals Company); REGAL® 400R, REGAL® 330R, REGAL® 660R, MOGUL® L, BLACK PEARLS® L, MONARCH® 700, MONARCH® 800, MONARCH® 880, MONARCH® 900, MONARCH® 1000, MONARCH® 1100, MONARCH® 1300, and MONARCH® 1400 (trade names, manufactured by Cabot Corporation); Color Black FW1, Color Black FW2, Color Black FW2V, Color Black 18, Color Black FW200, Color Black S150, Color Black S160, Color Black S170, Special Black 6, Special Black 5, Special Black 4A, and Special Black 4 (trade names, manufactured by Degussa), PRINTEX® 35, PRINTEX® U, PRINTEX® V, PRINTEX® 140U, and PRINTEX® 140V (manufactured by Degussa); No. 25, No. 33, No. 40, No. 47, No. 52, No. 900, No. 2300, MCF-88, MA 600, MA 7, MA 8, and MA 100 (trade names, manufactured by Mitsubishi Chemical Co., Ltd.).

Cyan colors include, but are not limited to, C. I. Pigment Blue-1, -2, -3, -15, -15:1, -15:2, -15:3, -15:4, -16, -22, and -60.

Magenta colors include, but are not limited to, C. I. Pigment Red-5, -7, -12, -48, -48:1, -57, -112, -122, -123, 146, -168, -184, and -202.

Yellow colors include, but are not limited to, C. I. Pigment Yellow-1, -2, -3, -12, -13, -14, -16, -17, -73, -74, -75, -83, -93, -95, -97, -98, -114, -128, -129, -138, -151, and -154.

In addition, a pigment that is self-dispersible in water may be employed as the pigment. A pigment that is self-dispersible in water is a pigment that has many water-soluble groups on the surface of a pigment and is stably dispersed in water without a presence of a macromolecule dispersing agent. Specifically, for example, a pigment that is self-dispersible in water is obtained by surface modifying treatment of a usual so-called pigment, such as acid and base treatment, coupling agent treatment, polymer graft treatment, plasma treatment, or oxidation/reduction treatment.

Pigments which are capable of being self-dispersed in water include CAB-O-JET® 200, CAB-O-JET® 200, IJX™ 253, IJX™ 266, IJX™ 444, IJX™ 273, and IJX™ 55 (manufactured by Cabot Corporation), MICROJET BLACK CW-1, and CW2 (trade names, manufactured by Orient Chemical Industries, Ltd.), which are commercially available, in addition to the pigments prepared by surface modifying treatment of the above pigments.

When a pigment that is self-dispersible in water is used as the pigment in the invention, there is a tendency of resulting in superior effects in long-time storability and the like. It is supposed that such effects are obtained because the pigment that is self-dispersible in water is hardly affected by other additives. It is also noted that when a pigment that is self-dispersible in water is used as the pigment in ink used in the invention, the ink may further contain macromolecule materials such as a macromolecule dispersing agent.

The amount of pigment that is used is from about 0.5 to 20% by weight, preferably from about 1 to 10% by weight, based on the amount of ink. If the amount of pigment in ink is less than about 0.5% by weight, a sufficient optical density cannot be obtained in some cases, and if the amount of pigment exceeds about 20% by weight, ejection characteristics of ink sometimes become unstable.

A macromolecule dispersing agent may be added to ink used in the invention for the purpose of dispersing the pigment in the ink. When a pigment that is self-dispersible in water is used, a macromolecule dispersing agent may also be added as a macromolecule material. Examples of the macromolecule dispersing agents that may be utilized in the invention include a nonionic compound, an anionic compound, cationic compound, and an amphoteric compound, the examples that may be used including copolymers of monomers having an α, β-ethylenic unsaturated group.

Specific examples of monomers having an α, β-ethylenic unsaturated group include acrylic acid, methacrylic acid, crotonic acid, itaconic acid, an itaconic acid monoester, maleic acid, a maleic acid monoester, fumaric acid, a fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycohol dimethacrylate, styrene, α-methylstylene, styrene derivatives such as vinyltoluene, vinylcylohexane, vinylnaphthalene, a vinylnaphthalene derivative, an acrylic acid alkylester, an acrylic acid phenylester, a methacrylic acid alkylester, a methacrylic acid phenylester, a methacrylic acid cycloalkylester, a crotonic acid alkylester, an itaconic acid dialkylester, and maleic acid dialkylester.

A copolymer obtained by the copolymerization of a single or a plurality of the above monomers having an α, β-ethylenic unsaturated group is used as a macromolecule dispersing agent. The specific examples include polyvinyl alcohol, polyvinyl pyrrolidone, a styrene-styrene sulfonate copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate ester-acrylic acid copolymer, a alkyl methacrylate ester-methacrylic acid, a styrene-alkyl methacrylate ester-methacrylic acid copolymer, a styrene-alkyl acrylate ester-acrylic acid copolymer, a styrene-phenyl methacrylate ester-methacrylic acid copolymer, and a styrene-cyclohexyl methacrylate ester-methacrylic acid copolymer.

A weight-average molecular weight of the high molecular dispersing agent is preferably in a range of from about 2,000 to 15,000. If the molecular weight of the high molecular dispersing agent is less than about 2,000, the pigment may not be stably dispersed, or if the molecular weight exceeds about 15,000, a viscosity of the ink becomes high and an ejecting performance thereof may be deteriorated. A more preferable weight-average molecular weight of the high molecular dispersing agent is 3,500 to 10,000.

The macromolecule dispersing agent is preferably added in a range of from about 0.1 to 3% by weight based on the ink. When the amount of addition exceeds about 3% by weight, a viscosity of the ink becomes high and ejection characteristics of the ink become unstable in some cases. On the other hand, when the amount of addition is below about 0.1% by weight, the dispersion stability of the pigment is sometimes decreased. The amount of addition of the macromolecule dispersing agent is more preferably from about 0.15 to 2.5% by weight, still more preferably from about 0.2 to 2% by weight.

Water-soluble organic solvents contained in the ink include polyvalent alcohols, polyvalent alcohol derivatives, nitrogen-containing solvents, alcohols, and sulfur-containing solvents. Specific examples of the polyvalent alcohols include ethylene glycol, diethylene glycol, propylene glycol, butylene glycol, triethylene glycol, 1,5-pentanediol, 1,2,6-hexanetriol, and glycerin. Specific examples of the polyvalent alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerin. Specific examples of the nitrogen-containing solvents include pyrrolidone, N-methyl-2-pyrrolidone, cyclohexylpyrrolidone, and triethanolamine. Specific examples of the alcohols include ethanol, isopropyl alcohol, butyl alcohol, and benzyl alcohol. Specific examples of the sulfur-containing solvents include thiodiethanol, thiodiglycerol, sulfolane, and dimethylsulfoxide. Additionally, propylene carbonate, ethylene carbonate, and the like may also be employed.

At least one species of water-soluble organic solvents is preferably used in ink used in the invention. The content of water-soluble organic solvent that is used is from about 1 to 60% by weight, preferably from about 5 to 40% by weight relative to the total amount of the ink. If the amount of water-soluble organic solvent in the ink is below about 1% by weight, a sufficient optical density cannot sometimes be obtained, and if the amount is more than about 60% by weight, a viscosity of the ink becomes high and ejection characteristics of the ink become unstable in some cases.

The ink may contain a surfactant. As a surfactant, a compound that has a structure having both a hydrophilic portion and a hydrophobic portion in the molecule and the like may be used. Surfactants that may be used include anionic surfactants, cationic surfactants, amphoteric surfactants, and nonionic surfactants. Moreover, the aforementioned macromolecule dispersing agent may be used as a surfactant as well.

Examples of the anionic surfactant include alkyl benzene sulfonates, alkyl phenyl sulfonates, alkyl naphthalene sulfonates, higher fatty acid salts, ester sulfates of higher fatty acid ester, sulfonates of higher fatty acid ester, ester sulfates of higher alcohol ether, sulfonates of higher alcohol ether, higher alkyl sulfosuccinates, higher alkyl ester phosphates, and ester phosphates of higher alcohol ethylene oxide adduct, and specific examples thereof include dodecyl benzene sulfonate, isopropyl naphthalene sulfonate, monobutyl phenyl phenol monosulfonate, monobutyl phenyl sulfonate, monobutyl biphenyl sulfonate, and dibutyl phenyl phenol disulfonate.

Examples of the nonionic surfactant include, for example, polypropylene glycol ethylene oxide adduct, polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, acetylene glycol, oxyethylene adduct of acetylene glycol, fatty acid alkanol amide, glycerin ester, and sorbitan ester.

Examples of the cationic surfactant include tetra-alkyl ammonium salts, alkylamine salts, benzalkonium salts, alkyl pyridium salts, and imidazolium salts, and specific examples thereof include dihydroxy ethyl stearyl amine, 2-heptadecenyl-hydroxy ethyl imidazoline, lauryl dimethyl benzyl ammonium chloride, cetyl pyridinium chloride, and stearamide methylpyridinium chloride.

Other examples include silicone surfactants such as polysiloxane oxyethylene adduct, fluorine surfactants such as perfluoroalkyl carbonate, perfluoroalkyl sulfonate, or oxyethylene perfluoroalkyl ether, and biosurfactants such as spiculisporic acid, ramnolipid, or rhizolecithin.

Among these, nonionic surfactants are preferable in view of dispersion stability of the pigment. Further, in view of controlling of permeability, acetylene glycol, oxyethylene adducts of acetylene glycol, polyoxyethylene alkyl ether, and the like are particularly preferable.

The amount of addition of the surfactant is preferably less than about 10% by weight, more preferably in a range of from about 0.01 to 5% by weight, still more preferably in a range of from about 0.01 to 3% by weight based on a total amount of ink. If the amount of addition is about 10% by weight or more, an optical density and a storage stability of pigment ink are sometimes deteriorated.

Ink used in the invention may further contain other additives for the purpose of controlling characteristics of the ink, such as ink ejection improvement. Examples of the other additives include polyethylene imine, polyamines, polyvinyl pyrrolidone, polyethylene glycol, ethyl cellulose, cellulose derivatives such as carboxymethyl cellulose, polysaccharide and derivatives thereof, other water-soluble polymers, polymer emulsions such as acrylic polymer emulsion or polyurethane emulsion, cyclodextrin, large cyclic amines, dentrimer, crown ethers, urea and derivatives thereof, and acetamide. Further, in order to adjust a conductivity or pH of the ink, various compounds may be added, examples of which include alkaline metal compounds such as potassium hydroxide, sodium hydroxide, or lithium hydroxide, nitrogen containing compounds such as ammonium hydroxide, triethanol amine, diethanol amine, ethanol amine, or 2-amino-2-methyl-1-propanol, alkaline earth metal compounds such as calcium hydroxide, acids such as sulfuric acid, hydrochloric acid, or nitric acid, and salts of strong acid such as ammonium sulfate and weak alkaline.

As required, moreover, other useful additives include pH buffers, antioxidants, antifungal agents, viscosity adjusting agents, conductive agents, ultraviolet absorbents, or chelating agents may be further added.

The treating liquid is not particularly limited as far as it contains components for aggregating the pigment in the ink (aggregating and/or thickening the ink). Specifically, for example, for an ink containing a pigment having an anionic group, an electrolyte, a cationic compound and the like may be contained in the treating liquid. Examples of the electrolytes that are effectively used in the invention include salts of: ions such as alkaline metal ions such as lithium ions, sodium ions, or potassium ions, or polyvalent metal ions such as aluminum ions, barium ions, calcium ions, copper ions, iron ions, magnesium ions, manganese ions, nickel ions, tin ions, titanium ions, or zinc ions; and acids such as hydrochloric acid, bromic acid, hydroiodic acid, sulfuric acid, nitric acid, phosphoric acid, thiocyanic acid, or organic carboxylic acids such as acetic acid, oxalic acid, lactic acid, fumaric acid, citric acid, salicylic acid, or benzoic acid, or organic sulfonic acids.

Specific examples of the electrolytes include: salts of alkaline metals such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate; and salts of polyvalent metals such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thioantimonate, calcium chloride, calcium bromide, calcium iodide, calcium nitrite, calcium nitrate, calcium dihydrogenphosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

The cationic compounds include primary, secondary, tertiary, and quaternary amines and salts thereof. Specific examples thereof include tetraalkylammonium salts, alkylamine salts, benzalkonium salts, alkylpyridinium salts, imidazolium salts, and polyamines; more specific examples thereof include isopropylamine, isobutylamine, t-butylamine, 2-ethylhexylamine, nonylamine, dipropylamine, diethylamine, trimethylamine, triethylamine, dimethylpropylamine, ethylenediamine, propylenediamine, hexamethyldiamine, diethylenetriamine, tetraethylenepentamine, diethanolamine, diethylethanolamine, triethanolamine, tetramethylammonium chloride, tetraethylammonium bromide, dihydroxyethylsteallylamine, 2-heptadecenyl-hydroxyethylimidazoline, lauryldimethylbenzylammonium chloride, cetylpyridinium chloride, stearamidemethylpyridinium chloride, diallyldimethylammonium chloride polymers, diallylamine polymers and monoallylamine polymers.

Preferable examples of the electrolytes include aluminum sulfate, calcium chloride, calcium nitrate, calcium acetate, magnesium chloride, magnesium nitrate, magnesium sulfate, magnesium acetate, tin sulfate, zinc chloride, zinc nitrate, zinc sulfate, zinc acetate, ammonium nitrate, aminoallylamine polymers, diallylamine polymers, and diallyldimethylammonium chloride polymers.

The treating liquid may contain an anionic compound and the like when ink which contains a pigment having a cationic group on the surface thereof is used. Examples of the anionic compounds that are effectively used in the invention include organic carboxylic acids, organic sulfonic acids, and salts thereof. Specific examples of the organic carboxylic acids include acetic acid, oxalic acid, lactic acid, fumaric acid, citric acid, salicylic acid, benzoic acid, and oligomers and polymers having plurality of these basic structures of the organic carboxylic acids. Specific examples of the organic sulfonic acids include compounds such as benzenesulfonic acid, toluenesulfonic acid, and oligomers and polymers having plurality of these basic structures of the organic sulfonic acids.

The above-describe compounds may be used singly or in a combination of two or more in the treating liquid. The content of the above compound to be used in the treating liquid is preferably from about 0.1 to 15% by weight, more preferably from about 0.5 to 10% by weight relative to a total amount of the ink.

The treating liquid may be made to contain a surfactant as in the ink. Examples of the surfactants used in the treating liquid are similar to those mentioned above.

In the invention, the printing liquid may also contain a substance for fixing the colorant on the recording medium (hereinafter, referred to as fixing substance). It is particularly effective to contain a fixing substance when a recording medium that hardly absorbs the ink components such as resin film is used.

The fixing substance includes water-soluble resin, resin emulsion, and water-soluble polymer. In particular, among these, the water-soluble resin and resin emulsion are preferred.

The water-soluble resin includes polyvinyl alcohol, alkyl ester acrylate-acrylic acid copolymer, styrene-alkyl ester methacrylate-methacrylic acid copolymer, styrene-maleic acid copolymer, styrene-methacrylic acid copolymer, styrene-acrylic acid copolymer, alkyl ester methacrylate-methacrylic acid, styrene-alkyl ester acrylate-acrylic acid copolymer, styrene-phenyl ester methacrylate-methacrylic acid copolymer, styrene-cyclohexyl ester methacrylate-methacrylic acid copolymer, and salts and derivatives of these copolymers.

The resin emulsion consists of continuous phase (water) and disperse phase (polymer particles), and the polymer particles are composed of any one of styrene-acrylic resin, styrene-butadiene resin, acrylic resin, styrene resin, cross-linking acrylic resin, epoxy resin, phenol resin, cross-linking styrene resin, butadiene resin, and silicone resin.

The fixing substance may be contained in the printing liquid, and is contained in the ink or treating liquid, or in both the ink and treating liquid. The content of the fixing substance is preferred to be in a range of about 0.1 to 50 mass % of the ink and/or treating liquid, more preferably in a range of about 1 to 20 mass %.

The surface tension of the ink (including the treating liquid) is preferred to be about 20 mN/m or more to less than about 60 mN/m, more preferably about 22.5 mN/m or more to less than about 40 mN/m. If the surface tension is about 20 mN/m or less, the liquid overflows to the nozzle surface, sometimes leading to a disruption of normal printing. If exceeding about 60 mN/m, permeation slows and drying time is long, and the ink may have difficulty in being absorbed in the liquid absorbing member.

Herein, the surface tension is measured by surface tension meter (trade name: CVBP-Z, manufactured by Kyowa Interface Science CO., LTD.) in the environment of 23° C., 55% RH.

The viscosity of the ink (including the treating liquid) is preferred to be about 1.2 mPa·s or more to less than about 8.0 mPa·s, and more preferably about 1.5 mPa·s or more to less than about 6.0 mPa·s. If the viscosity is lower than about 1.2 mPa·s, the long-term reliability may degrade. If exceeding about 8.0 mPa·s, the ejection performance may be lowered, and the ink may have difficulty in being absorbed in the liquid absorbing member.

Herein, the viscosity is measured by TVE-20L (trade name, manufactured by Toki Sangyo). The measuring condition is temperature of 23° C. and shearing speed of 750 $s^{-1}$.

The operation of the ink jet recording apparatus having such a structure is described below.

In a printing operation, first, the paper is supplied from the paper feed section 12, controlled in position and timing by the registering section 14, and is conveyed into the recording section 16. In the recording section 16, a motor (not shown in the figure) is driven, and the driving force is transmitted to all conveying rollers 40 by way of a flat belt.

The paper reaching the recording section 16 is inserted between the conveying roller 40 at the uppermost upstream side of the conveying direction and the star wheel 42. At this time, the star wheel 42 forced by a spring (not shown) presses the paper to the conveying roller 40, and the conveying force is transmitted securely from the conveying roller 40 to the paper, and the driving force is sequentially transmitted from the conveying rollers 40 disposed among the printheads 28 at a constant speed, and the paper is conveyed.

When a print signal is supplied to the printhead 28 from the control section of the apparatus, the heat generating element of the corresponding nozzle generates heat, and the ink is ejected from the nozzle to the paper being conveyed at a specific distance from the nozzle surface.

The printhead 28 prints, and printing of one color in the corresponding area of the paper is executed and finished in the maximum recording area of the recording medium of the paper. Thus, as the paper is conveyed in the recording section 16, printing is executed in the sequence of the printheads 28T, 28K, 28C, 28M, and 28Y, and the image is printed in full color.

At this time, since the ink is printed by the printheads 28C to 28Y on the treating liquid printed by the printheads 28T, the pigment contained in the ink is roughly aggregated by the treating liquid.

Next, by the liquid absorbing device 34 installed at the downstream side of each printhead, the excessive ink component of the ink of each color remaining on the ink image of the paper is absorbed. After the image is printed by the ink, the paper reaches the paper discharge section 18, and is collected in the tray 38 by way of the paper discharge belt 36.

Thus, in the embodiment, excessive ink components in the ink image on the paper are absorbed by the liquid absorbing device 34. The side of the liquid absorbing device 34 contacting with the ink image is composed of the liquid absorbing member of the invention, realizing so-called soft absorption of ink components, and only the liquid components of the ink components can be absorbed. Thus, image quality is not spoiled even in the case of using art paper or the like which hardly absorbs ink.

In the embodiment, especially in the case of using a two-pack ink set, the pigment contained in the ink aggregated to form large particles, and the excessive ink components, are absorbed by the liquid absorbing device 34. The pigment (aggregate) and excessive ink components can be securely separated and absorbed, so that the image density is enhanced.

Even if the excessive liquid cannot be separated easily from the pigment (aggregate), the hydrophilic absorbing layer 54 of the liquid absorbing member is composed of the liquid absorbing member of the invention, and hence it is ensured that only the excessive ink components are absorbed without absorbing the pigment.

Also in the embodiment, the printhead 28 and liquid absorbing device 34 are formed in a printing area (absorbing area) corresponding to the maximum width PW of the paper, and the image can be printed in the overall width of the paper without scanning the printhead 28, and therefore there is hardly any difference occuring in the drying and permeating state of the printing liquid (ink, treating liquid) ejected on the paper, and in this state the liquid absorbing device 34 absorbs the excessive ink components on the ink image, so that curl, cockle, and drying can be effectively improved.

The invention can be also applied to a print system having unit printheads (short heads) arrayed in the paper width.

EXAMPLES

The present invention is specifically described below by referring to examples. It must be noted however that the invention is not limited to the examples.

Preparation of Ink and Treating Liquid

Colorant solvent, water-soluble organic solvent, surfactant, and ion exchange water are added in specified composition, and the mixed solution is stirred and agitated. The obtained liquid is passed through a membrane filter of 2 μm, and a desired liquid is obtained.

Preparation of Black Pigment Disperse Solution

A pigment disperse solution is obtained by centrifugal separation for 30 minutes at 8000 rpm by using CAB-O-JET® 300 (manufactured by Cabot CO., LTD.). Part of the pigment disperse solution is sampled, dried, and the amount of the pigment content is determined, and purified water is added until the pigment concentration becomes 10 mass % on the basis of the obtained result, to obtain a black pigment disperse solution.

Black Ink

Black pigment disperse solution, 45 parts by mass

Diethylene glycol, 20 parts by mass

Polyoxy ethylene adduct of 2-ethyl hexyl alcohol, 0.15 parts by mass

Polyoxy ethylene oleyl ether, 0.07 parts by mass

Urea, 6 parts by mass

Antifungal agent PROXEL GXL (trade name, manufactured by Zeneca), 0.1 parts by mass Ion exchange water, 28.68 parts by mass Treating Liquid Diglycerin ethylene oxide adduct, 10 parts by mass Calcium nitrate tetrahydrate, 3 parts by mass Surfactant SURFINOL 465 (trade name, manufactured by Nisshin Chemical Industry CO., LTD.), 3 parts by mass Isopropyl alcohol, 3 parts by mass Ion exchange water, 81 parts by mass Printing Conditions Using piezo ink jet printing apparatus for evaluation of multipass printing comprising two trial ink jet printing heads of 800 dpi, 256 nozzles, one head is used for printing and the other head for the treating liquid. The ejecting volume is about 10 pl, the printing is one-side batch printing, the head scan speed is about 25 cm/sec, and the printing speed (paper conveying speed) is 360 mm/sec. In the case of two-pack printing, the treating liquid is printed in the image forming area, and then the ink is printed (at this time, the ratio by mass of treating liquid and ink (treating liquid/ink) is 1/0.5). Unless otherwise specified, the printing condition is a general environment (temperature: 23+/−0.5° C., humidity: 55+/−5% RH).

Liquid Absorbing Device

The liquid absorbing member is members A to D containing fibrous matter shown in Table 1, which are processed into tubular form to be used as rollers, and a liquid absorbing device having the roller-form liquid absorbing member shown in FIG. 2 is manufactured. This liquid absorbing device is disposed at the paper discharge side of the ink jet recording apparatus such that the liquid absorbing member may contact with the ink image for 0.01 seconds at a pressure of 0.5 MPa at 0.2 seconds after printing.

TABLE 1

| | Liquid absorbing member | | | |
|---|---|---|---|---|
| | A | B | C | D |
| Fiber material | Polyacrylic acid | Resin containing polyacrylic acid | Polyester | Polyacrylic acid |
| Fiber thickness (dtex) | 10.0 | 5.9 | 0.07 | 150 |
| Fiber diameter (μm) | — | — | 2 | 20 |
| Fiber weight (g/cm$^2$) | 100 | 500 | 700 | 4000 |
| Water absorption (sec) | 0.3 | 0.08 | 0.06 | 3 |

Examples 1 to 3, Comparative Examples 1 and 2

The recording medium is art paper High Quality Art (trade name, manufactured by Mitsubishi Paper Mills Limited), the printing liquid is blank ink only, the liquid absorbing member is the liquid absorbing device shown in Table 2, and printing is evaluated as follows. Comparative example 2 is printed without using a liquid absorbing device.

Dryness

A solid image of 2 cm×10 cm is printed, and 5 seconds after printing, FX-L paper (trade name, manufactured by Fuji Xerox) is applied on the ink image, and a load of 100 g/cm$^2$ is applied. The state of contamination of ink transferred on the paper is observed, and the result is evaluated as follows.

A: No contamination at all.

B: Contamination slightly observed.

C: Contamination clearly observed.

Image disturbance

Printing a solid image of 5 cm×5 cm, the image after treatment by a liquid absorbing device is visually observed, and evaluated as follows.

A: No image disturbance.

C: Image disturbance observed.

Results are shown in Table 2.

Example 4

The sample is printed and evaluated in the same manner as in Example 3 except that the recording medium is changed to polyester resin film (trade name: SEEK, manufactured by TOYOCLOTH CO., LTD.).

Results are shown in Table 2.

Example 5

The sample is printed and evaluated in the same manner as in Example 3 except that the printing liquid contains treating liquid in addition to the black ink (two-pack system).

Results are shown in Table 2.

TABLE 2

| | Printing liquid | Recording medium | Liquid absorbing member | Dryness | Image disturbance |
|---|---|---|---|---|---|
| Example 1 | Ink only | Art paper | A | A | A |
| Example 2 | Ink only | Art paper | B | A | A |
| Example 3 | Ink only | Art paper | C | A | A |

TABLE 2-continued

| | Printing liquid | Recording medium | Liquid absorbing member | Dryness | Image disturbance |
|---|---|---|---|---|---|
| Example 4 | Ink only | Polyester resin film | C | A | A |
| Example 5 | Ink + treating liquid | Art paper | C | A | A |
| Comparative example 1 | Ink only | Art paper | D | C | C |
| Comparative example 2 | Ink only | Art paper | — | C | — |

As can be known from the results shown in Table 2, Examples 1 to 3 are free from problems both in dryness immediately after printing and image disturbance. In Example 4, using resin film as the recording medium, similar dryness and image stability are confirmed. On the other hand, in the liquid absorbing member containing fibrous matter of larger fiber thickness than the specified range of the invention, sufficient dryness and image fixing are not obtained as shown in comparative example 1. In comparative example 2 printed without using a liquid absorbing device, the ink image is not absorbed by the paper and is mostly left on the paper, and the paper, cannot be used as recording medium.

What is claimed is:

1. A liquid absorbing member for absorbing excessive ink components from an ink image formed on a recording medium during ink jet recording, wherein the liquid absorbing member comprises, on a surface thereof, a hydrophilic absorbing layer which contains fibrous matter, the recovery rate of fine particles having a volume-average particle size of 5 μm by the hydrophilic absorbing layer alone is 90% or more, and the fiber thickness of fibers composing the fibrous matter is in a range of about 0.01 to 100 dtex, and the fiber weight of the fibrous matter per square centimeter is in a range of about 20 to 3,000 g/cm$^2$, and the liquid absorbing member being in contact with the ink image formed on the recording medium, the liquid absorbing member absorbing the excessive ink components from the ink image by said contact.

2. The liquid absorbing member of claim 1, wherein the fibrous matter contains fibers having a fiber diameter in a range of about 0.5 to 10 μm.

3. The liquid absorbing member of claim 1, wherein the fibers composing the fibrous matter are polyester fibers.

4. The liquid absorbing member of claim 1, wherein a water absorption of the fibrous material, as measured by the water dripping method, is 1 second or less.

5. An ink jet recording apparatus comprising:

a printhead for forming an ink image by ejecting a printing liquid containing ink onto a recording medium, and a liquid absorbing portion that contacts the ink image formed on the recording medium to absorb excessive ink components from the ink image, wherein a liquid absorbing member used for the liquid absorbing portion comprises, on a surface thereof, a hydrophilic absorbing layer which contains fibrous matter, the recovery rate of fine particles having a volume-average particle size of 5 μm by the hydrophilic absorbing layer alone is 90% or more, and the fiber thickness of fibers composing the fibrous matter is in a range of about 01 to 100 dtex and the fiber weight of the fibrous matter per square centimeter is in a range of about 20 to 3,000 g/cm$^2$.

6. The ink jet recording apparatus of claim 5, wherein the fibrous matter contains fibers having a fiber diameter in a range of about 0.5 to 10 μm.

7. The ink jet recording apparatus of claim 5, wherein the fibers composing the fibrous matter are polyester fibers.

8. The ink jet recording apparatus of claim 5, wherein a water absorption of the fibrous material, as measured by the water dripping method, is 1 second or less.

9. The ink jet recording apparatus of claim 5, wherein the recording medium is art paper or resin film.

10. The ink jet recording apparatus of claim 5, wherein the ink contains water and colorant, and is at least one of cyan ink, magenta ink, yellow ink, and black ink.

11. The ink jet recording apparatus of claim 5, wherein the printing liquid comprises the ink and a treating liquid containing components for aggregating and/or thickening the ink.

12. The ink jet recording apparatus of claim 5, wherein the printing liquid contains a substance for fixing the colorant on the recording medium.

13. The ink jet recording apparatus of claim 12, wherein the fixing substance is at least one of a water-soluble resin and a resin emulsion.

14. The ink jet recording apparatus of claim 12, further comprising a portion for drying the ink components absorbed in the fibrous matter of the liquid absorbing member.

15. The liquid absorbing member of claim 1, wherein the fiber weight of the fibrous matter per square centimeter is in a range of about 25 to 2,500 g/cm$^2$.

16. The ink jet recording apparatus of claim 5, wherein the fiber weight of the fibrous matter per square centimeter is in range of about 25 to 2,500 g/cm$^2$.

* * * * *